United States Patent [19]

Kaspar et al.

[11] Patent Number: 4,778,048

[45] Date of Patent: Oct. 18, 1988

[54] PRODUCT CONTAINING A TILTED STACK OF WET WIPES

[75] Inventors: Mark L. Kaspar, Oshkosh; Terry L. Petty, Neenah, both of Wis.

[73] Assignee: Kimberly-Clark Corporation, Neenah, Wis.

[21] Appl. No.: 138,230

[22] Filed: Dec. 28, 1987

[51] Int. Cl.[4] ..... B65D 1/36; B65D 85/06

[52] U.S. Cl. ..... 206/205; 206/449; 206/561

[58] Field of Search ..... 206/557, 561, 449, 425, 206/205

[56] References Cited

U.S. PATENT DOCUMENTS

| | | | |
|---|---|---|---|
| 1,916,119 | 6/1933 | Schwartz et al. | 206/449 |
| 2,665,808 | 1/1954 | McAlister | 206/561 X |
| 3,726,395 | 4/1973 | Duhy | 206/205 X |
| 3,767,057 | 10/1973 | Holmes | 206/561 X |
| 3,819,043 | 6/1974 | Harrison | 206/205 X |
| 3,836,044 | 9/1974 | Tilp et al. | 206/205 X |
| 3,836,045 | 9/1974 | Duhy et al. | 206/205 X |
| 3,841,466 | 10/1974 | Hoffman et al. | 206/205 |
| 4,000,816 | 1/1977 | Spruyt | 206/205 X |
| 4,366,904 | 1/1983 | Roskvist | 206/561 X |
| 4,396,119 | 8/1983 | Giulie | 206/425 |

*Primary Examiner*—William Price

*Attorney, Agent, or Firm*—Gregory E. Croft

[57] ABSTRACT

A product comprising a stack of wet wipes tilted on edge within a container provides improved access for dispensing and relatively equal liquid amounts for each wipe within the container.

5 Claims, 1 Drawing Sheet

FIG. 3A

PRODUCT CONTAINING A TILTED STACK OF WET WIPES

BACKGROUND OF THE INVENTION

Wet wipes, such as those used for infant care, are well known products. Typically such wipes come in a container or tub in which a large number of individual folded wipes are laid flat and stacked vertically. The entire stack is saturated with a cleansing liquid. Although commercially successful, such products suffer from two distinct disadvantages. First, it can be very difficult for the user to locate, grasp, and quickly remove the uppermost wipe of the stack without some groping around for the exosed edge of the folded wipe. This problem is accentuated when trying to remove those wipes near the bottom of the stack which have been compressed by the weight of the upper part of the stack and cling together more tenaciously. Those who have changed diapers will appreciate the importance of being able to quickly remove a wipe rrom the container with one hand. In addition, most wet wipes suffer from a varying liquid content which increases from the top of the stack (the driest) to the bottom of the stack (the wettest). This not only makes for varying quality and effectiveness for individual wipes within the container, it also furthers adherence of the bottom wipes of the stack to each other as mentioned above.

Therefore there is a need for a wet wipe product which provides consistent moisture content among the individual wipes within the container and also provides easy access and removal of all of the wipes within the container.

SUMMARY OF THE INVENTION

In general, the invention resides in a stack of folded wet wipes within a dispensing container, wherein the folded wet wipes within the stack are tilted on edge at an angle of from about 30° to about 85° relative to horizontal, preferably at an angle of from about 60° to about 70°. As previously mentioned, wet wipes at the bottom of a stack of horizontal wipes tend to stick together, making it difficult to remove just one at a time. It has been discovered that by tipping the stack on edge to the proper degree, the liquid concentration of each wipe remains relatively equal without sticking. At the same time, because the individual wipes within the stack are not perfectly vertical, there is provided adequate ease of access to the wipe from the top of the dispensing container. Ease of access is important for reliably locating the edge of the folded wet wipe to remove it from the container. For purposes herein, a wet wipe is any wipe containing a liquid add-on of about 50 weight percent or more.

In connection with the abovesaid arrangement, it is preferred that the bottom of the dispensing container contain a series of parallel ribs upon which the stack of folded wipes rests and which are parallel to the bottom edges of the wipes to inhibit lateral slippage of the bottom edges of the wipes. This feature of the invention helps to prevent sagging of the tilted stack as more and more of the wipes within the stack are removed.

It is also preferred that the edge of each wipe, which is exposed for grasping and removal of the wipe from the container, have a Gurley Stiffness greater than that of the main body of the wipe by at least 10 percent or more. Advantageously the stiffness of the edge is at least 40 percent greater, preferably 75 percent greater, and most preferably 150 percent greater than the main body of the wipe. It has been discovered that wipes having a sufficiently stiff edge are easier to locate, grasp, and remove from the container. Since only the edge of the wipe is stiff, the main body of the wipe is still functionally and aesthetically unaffected. It is preferred, but not necessary, that the stiff edge include a visual indication as an aid to the user for locating the stiff edge, such as a color change or decorative embossing along the edge.

For purposes herein, the "edge" of the wipe includes all portions of the wipe within about one inch from the perimeter or extremity of the wipe. All portions of the edge need not be stiffer than the main body of the wipe so long as some portion of the edge is stiffer. Stiff edges can be created by a number of different methods, including: adhesive, sonic, or thermal bonding a separate material or folded-over section of the wipe to the edge of the main body of the wipe; extruding, coating, or spraying a substance, such as a thermoplastic, onto the edge of the wipe; forming the wipe base material so that the edge portion is stiffer than the remaining portion of the web; mechanically compressing or densifying the edge portion of the wipe, such as by crimping and/or melting the edge of the wipe base material; or folding the wipe upon itself one or more times to provide a multiply edge. The stiffness of the edge can be continuous or discontinuous.

The stiffness of the edge of the wipe and the main body of the wipe can be determined using a Gurley Stiffness tester (Model 4171 available from W. & L. E. Gurley, Troy, N.Y.) in accordance with TAPPI standard test PSSMA-TAPPI. Those skilled in the art will appreciate that the sample size and orientation of the edge of the wipe when running the Gurley Stiffness test may vary depending upon the width of the stiff edge and the magnitude of the stiffness. However, it has been found that a sample size of 1 inch long by 1.5 inches wide, with the stiff edge running in the lengthwise direction of the sample and perpendicular to the top edge of the Gurley Stiffness tester pendulum, works well in combination with a 5 gram weight positioned 2 inches from the center of the pendulum.

These and other aspects of the invention will be described in more detail with reference to the Drawing.

DETAILED DESCRIPTION OF THE DRAWING

Figure 1:
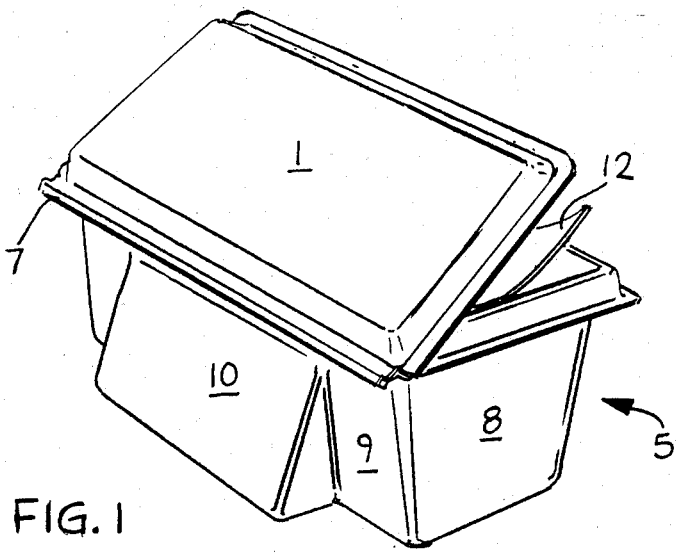
FIG. 1 is a perspective view of a container for the product of this invention, as viewed looking at a rear corner of the container.

FIG. 1 shows a dispensing container design for improved dispensing of wet wipes in accordance with this invention. Shown is a lid 1 which is attached to the tub portion 5 by a living hinge 7. The tub portion of the container generally comprises a front sidewall (not shown), two side sidewalls 8, a rear sidewall 9, and a floor or bottom adapted to rest on a horizontal surface.

(For purposes herein, the "bottom" of the container is that portion of the container which is horizontal during normal use. The wipes within the container need not be resting on the bottom of the container.) The juncture of the rear sidewall and the lid constitutes the abovesaid hinge. Also, the rear sidewall is preferably slanted outwardly to support the tilted stack of wipes as hereinafter illustrated. It also preferably includes a foot 10 which serves as a support means to prevent the container from tipping over onto the rear sidewall. Also shown is a plastic or foil seal (lidding) 12 which prevents the escape of moisture from the container prior to being opened for the first time. It will be appreciated that the design of the lid closure mechanism, including the hinge, can be of any suitable design which adequately performs its function.

Figure 2:
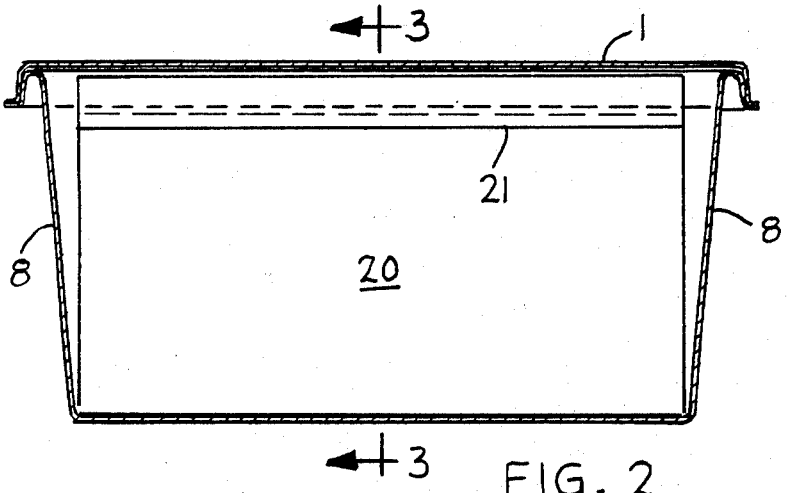
FIG. 2 is a front sectional elevation of the closed container of FIG. 1.

FIG. 2 shows a front sectional elevation of the closed container of FIG. 1, illustrating the wipes within the container. Shown is a wipe 20 having a stiff edge 21 which continuously extends the width of the wipe. Also shown are the two side sidewalls 8 and the bottom sidewall 22.

Figure 3:
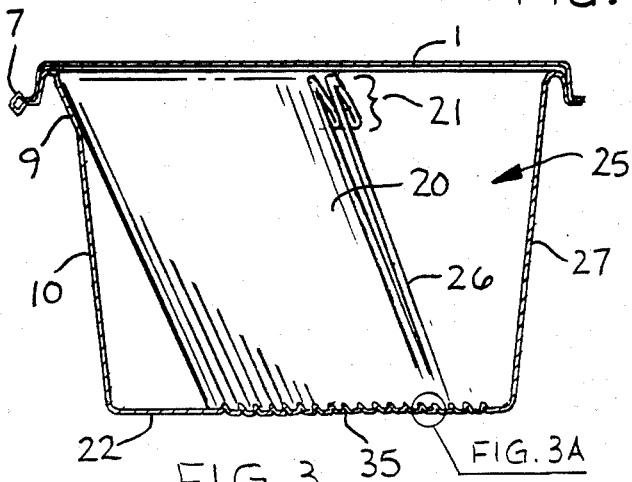
FIG. 3 is a sectional side view of the container of FIG. 1, showing the position of the wipes within the container.

FIG. 3 is a sectional side view of the container of FIG. 1 taken along line 3—3 of FIG. 2, further showing the position of the wipes within the container. Specifically, the wipes 20 are stacked one against the other and tilted on edge such that they are at an angle of about 70° relative to the bottom 22 of the container, which is horizontal when the container is resting on a horizontal surface during normal use. The wipes are partially supported by the rear sidewall, which slants outwardly from the bottom of the container. The space 25 between the first wipe 26 and the front sidewall 27 provides the user with easy access to the wipe from the front of the container. The stiff edge 21 of the wipe as shown is at or near the uppermost edge of the wipe, but the edge can be located at a lower position as desired as long as the user can easily find and grasp the stiff edge to remove the wipe.

The bottom or floor of the container is provided with a series of ribs 35 or other protrusions as necessary to prevent or retard the tilted wipes from sliding or shifting within the container. This feature of the invention becomes more important as the wipes within the stack are used up and front space 25 becomes larger. If the wipes are permitted to collapse to a substantially horizontal position, the relatively equal liquid content will be adversely affected.

Figure 3A:
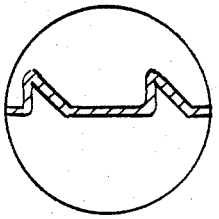
FIG. 3A is an expanded partial section of the floor of the container of FIG. 3, showing the ribs in the floor which prevent the wipes from sliding.

FIG. 3A is an enlarged partial sectional view of the bottom of the container, illustrating a preferred design of the protrusions. In this case the protrusions are equally-spaced ribs 35 extending the full width of the bottom of the container. The spacing of the ribs is about 11 millimeters, which provides sufficient space between adjacent ribs for 10 folded wipes. The height of the ribs is about 5 millimeters. It will be appreciated, however, that other surface protrusions can also be used to keep the wipes in place, such as intermittent ribs, steps, circular protrusions or knobs, etc. The common functional aspect is to provide sufficient surface texture or friction to retard slippage of the stacked wipes within the container. Adhesives can also be used to provide the necessary friction.

It will be appreciated that the foregoing examples are for purposes of illustration only and are not to be construed as limiting the scope of this invention, which is defined by the following claims.

We claim:

1. A wet wipe product comprising a stack of folded wet wipes within a dispensing container, wherein the folded wipes within the stack are tilted on edge such that the folded wipes are at an angle of from about 30° to about 85° relative to horizontal.

2. The product of claim 1 wherein the wipes are at an angle of from about 60° to about 70° relative to horizontal.

3. The product of claim 1 wherein the bottom of the container comprises a textured surface upon which the stack of folded wipes rests, thereby inhibiting lateral slippage of the bottom edges of the wipes.

4. The product of claim 3 wherein the textured surface comprises a series of ribs which are parallel to the bottom edges of the folded wipes.

5. The product of claim 4 wherein the container comprises a foot which prevents the container from tipping over.

* * * * *